US007069753B2

(12) United States Patent
Schlipper

(10) Patent No.: US 7,069,753 B2
(45) Date of Patent: Jul. 4, 2006

(54) SECURITY LUGGAGE BAG

(75) Inventor: Robert W Schlipper, Hong Kong (HK)

(73) Assignee: MRM Holdings Limited, Port Louis (MU)

( * ) Notice: Subject to any disclaimer, the term of this patent is extended or adjusted under 35 U.S.C. 154(b) by 0 days.

(21) Appl. No.: 10/208,704

(22) Filed: Jul. 30, 2002

(65) Prior Publication Data

US 2003/0110818 A1 Jun. 19, 2003

(30) Foreign Application Priority Data

Aug. 14, 2001 (AU) ..... PR6989

(51) Int. Cl.
*E05B 73/00* (2006.01)

(52) U.S. Cl. ..... 70/18; 70/65; 70/59; 70/14

(58) Field of Classification Search ..... 70/14, 70/18, 19, 60–65, 30, 49, 59, 58
See application file for complete search history.

(56) References Cited

U.S. PATENT DOCUMENTS

| | | | | | |
|---|---|---|---|---|---|
| 866,965 | A * | 9/1907 | Redding | | 70/65 |
| 1,201,972 | A * | 10/1916 | Kelly | | 70/65 |
| 1,706,387 | A * | 3/1929 | Kramer | | |
| 3,762,191 | A * | 10/1973 | Smith | | 70/18 |
| 3,831,407 | A * | 8/1974 | Coleman | | 70/18 |
| 4,024,738 | A * | 5/1977 | Pi | | 70/59 |
| 4,063,637 | A * | 12/1977 | Danforth | | 70/59 X |
| 4,388,739 | A * | 6/1983 | Martinon et al. | | 8/150 |
| 4,783,978 | A * | 11/1988 | Vallerga | | 70/65 |
| 5,031,641 | A * | 7/1991 | Upton | | 70/18 X |
| 5,582,043 | A * | 12/1996 | McCue et al. | | 70/58 |
| 6,026,662 | A * | 2/2000 | Schlipper | | 70/18 |
| 6,077,587 | A * | 6/2000 | Potok | | 70/62 X |
| 6,244,081 | B1 * | 6/2001 | Schlipper | | 70/18 |

FOREIGN PATENT DOCUMENTS

| | | | |
|---|---|---|---|
| DE | 8900151 | * 5/1989 | |
| DE | 19815510 | * 11/2000 | |
| FR | 431377 | * 11/1911 | 70/65 |
| JP | 11079028 | * 3/1999 | |

* cited by examiner

*Primary Examiner*—Suzanne Dino Barrett
(74) *Attorney, Agent, or Firm*—Craig Fieschko; DeWitt Ross & Stevens

(57) ABSTRACT

A bag 10 has a security wire netting 12 that is closed by tightening a draw line 14 and locking the draw line taut. When the netting is not in use, the netting 12, due to its configuration, can be readily folded up and placed or held around a top periphery of the bag. This enables the bag to be more conveniently used for simple storage of articles when no security is required.

5 Claims, 3 Drawing Sheets

SECURITY LUGGAGE BAG

The invention relates to security luggage bags.

In U.S. Pat. No. 6,026,662 a security bag and a device for closing an opening in the bag is disclosed. A steel wire netting is used that may be covered with fabric or actually surround a fabric luggage holder (or bag). The netting has an upper opening where the netting can be drawn by a draw wire to close off the opening. In some situations this arrangement is cumbersome and the bag is difficult to use comfortably if it is to be left open, such as when clothes or other articles in the bag need to be simply stored while retaining easy access into the bag.

It is an object of the invention to overcome or at le/st least reduce this problem.

According to the invention there is provided an upright open-topped security bag for storing articles, a top closure that can be drawn closed to close off the top and secure it closed, in which the top closure comprises a separate metal wire netting attached around the top of the bag, a draw line that is threaded through looped wire ends of the netting, forming an inner periphery of the netting, arranged to draw the loops together towards a centre of the open top, and a releasable lock to hold the draw line taut. The bag may be reinforced by another netting that is attached to the separate netting around the top surface of the bag.

A cover may be included that fits over and supports the separate netting when it is folded to lie around a top region of the bag.

A security luggage bag according to the invention will now be described by way of example with reference to the accompanying drawings in which.

Figure 1:
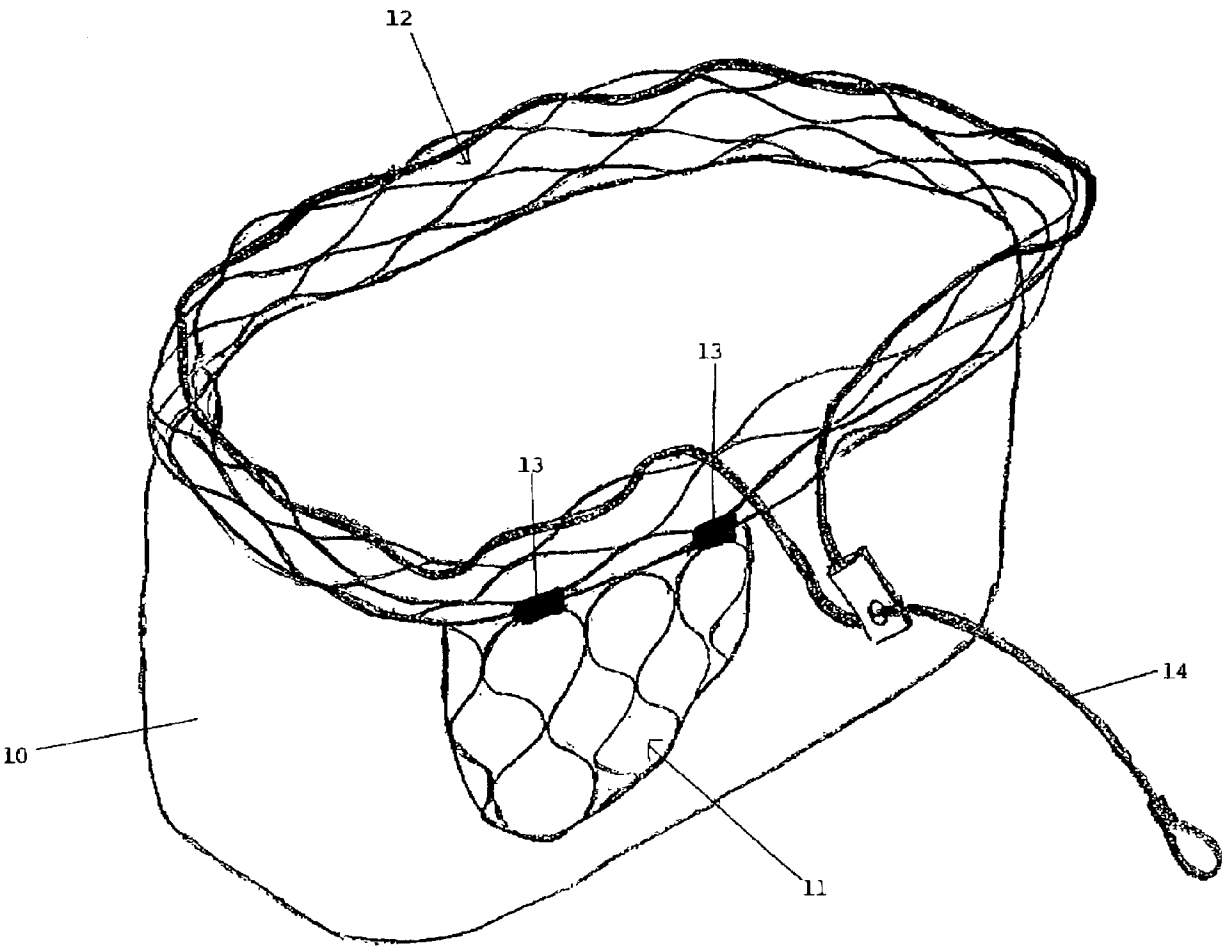
FIG. 1 is an isometric view of the bag with its top open.

Referring to the drawings, in FIG. 1 a generally upright luggage bag 10 is formed with a fabric coated netting 11, partially exposed for illustration in the drawing. The netting arrangement 11 is as described in U.S. Pat. No. 6,026,662 except that the bag has an open top and a second netting 12 attached by interwoven loops to the netting 11 or by clips 13. A draw line 14 is threaded into loops of the netting 12 that form an inner periphery of that netting. When the draw line is pulled, the loops are drawn toward the centre of the open top and the draw line can be locked by a lock (such as described in U.S. Pat. No. 6026,662) to hold the draw line taut. Thereafter the contents of the bag remain secure and cannot be removed out of the top of the bag.

It will be observed here that the general plane of the netting 12 is horizontal when the netting is secured by the taut draw line. More important, the individual wires of loops of the netting 12 generally or naturally extend "along" the netting, rather than across the netting. This allows the netting 12 to be more easily folded or pressed in a relatively small core with the attached wires of the netting running side by side. This can be appreciated in FIG. 2 where the netting 12 has been folded away and retained behind a sausage-like fabric cover 15. The cover may be zipped, have a Velcro (Trade Mark) layer, or be interspaced Velcro patches, to hold the cover more securely against an upright surface of the bag 10.

Figure 3:
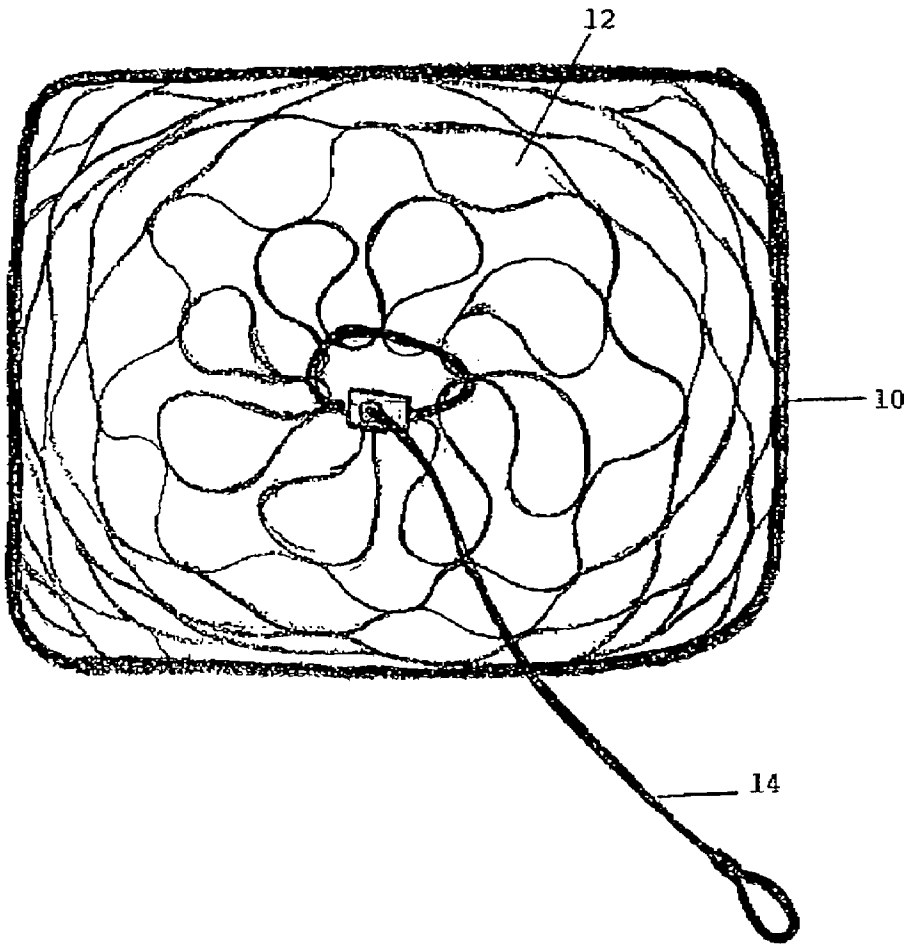
FIG. 3 is a top plan view of the bag with its top closed.

FIG. 3 shows the netting 12 drawn across the top of the bag 10 by the draw line 14 and held in position to close off the top of the bag. In this configuration normal contents of the bag cannot be removed.

The described bag has the 'security' netting 12 attached in readiness when needed or for use during camping or travelling when the bag is mounted on a motorcycle for example. Advantageously when the described bag is not required to be securely closed, the netting 12 can be conveniently stored or at least pushed aside to facilitate usage of the bag without tangling with the netting 12 as articles are packing into or removed from the bag.

Figure 2:
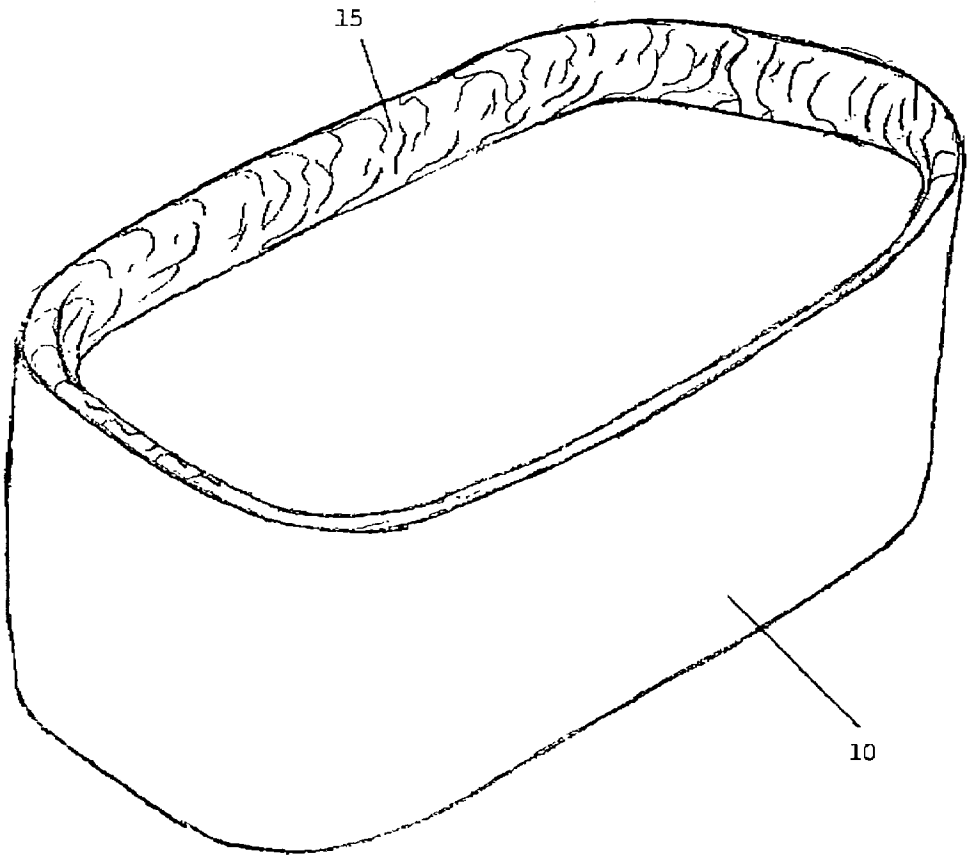
FIG. 2 is another isometric view of the bag with its top open.

The netting 12 may be used with other forms of bag, where the bag itself may or may not be reinforced with metal or other wire nettings. The nettings 11 and 12 may be formed as 'one' netting. However, the configuration of the netting part 12 must be arranged generally as shown with the runs of wire passing around and along the netting and not 'across' the netting. Otherwise the natural resilience of the wire makes the netting difficult to fold away for storage as illustrated in FIG. 2.

The draw wire may be held taut where required by a lock in the form of a releasably brake.

What is claimed is:

1. An upright open-topped security bag for storing articles, a top closure that can be drawn closed to close off the top of the bag and secure the bag closed, in which the top closure comprises a separate metal wire netting attached around the top of the bag, a draw line that is threaded through looped wire ends of the netting, forming an inner periphery of the netting, arranged to draw the loops together towards a center of the open top, and a releasable lock to hold the draw line taut.

2. An upright open-topped security bag according to claim 1, in which the bag is reinforced by another netting that is attached to the separate netting around the top surface of the bag.

3. An upright open-topped security bag according to claim 1, including a cover that fits over and supports the separate netting when the separate netting is folded to lie around a top region of the bag.

4. An upright open-topped security bag according to claim 2, including a cover that fits over and supports the separate netting when the separate netting is folded to lie around a top region of the bag.

5. An upright open-topped security bag for storing articles, the bag being reinforced with a wire netting having a top closure that can be drawn closed to close off the top of the bag and secure the bag closed, the bag having a draw line that is threaded through looped wire ends of the netting, the draw line forming an inner periphery of the netting, the draw line being arranged to draw the loops together towards a center of the open top of the bag, and a releasable lock to hold the draw line taut, wherein the individual of wires of the netting of the top closure are aligned horizontally around the bag, in a similar direction to the draw line.

* * * * *